United States Patent [19]

Curry et al.

[11] Patent Number: 4,981,036

[45] Date of Patent: Jan. 1, 1991

[54] METHOD OF DETERMINING THE POROSITY OF AN UNDERGROUND FORMATION BEING DRILLED

[75] Inventors: David Curry, Toft, England; Michael Sheppard, Missouri City, Tex.

[73] Assignee: Anadrill, Inc., Sugar Land, Tex.

[21] Appl. No.: 372,987

[22] Filed: Jun. 28, 1989

[30] Foreign Application Priority Data

Jul. 20, 1988 [GB] United Kingdom ..... 8817215

[51] Int. Cl.[5] ..... E21B 49/00

[52] U.S. Cl. ..... 73/151; 175/50

[58] Field of Search ..... 73/151, 151.5, 152, 73/38; 175/39, 40, 50

[56] References Cited

U.S. PATENT DOCUMENTS

| | | | |
|---|---|---|---|
| 2,372,576 | 3/1945 | Hayward | 73/152 |
| 4,064,749 | 12/1977 | Pittman et al. | 73/152 |
| 4,570,480 | 2/1986 | Fontenot et al. | 73/155 |
| 4,627,276 | 12/1986 | Burgess et al. | 73/151 |
| 4,685,329 | 8/1987 | Burgess | 73/151 |
| 4,722,095 | 1/1988 | Muegge et al. | 378/4 |
| 4,779,200 | 10/1988 | Bradbury et al. | 73/155 |
| 4,833,914 | 5/1989 | Rasmus | 73/152 |
| 4,852,399 | 8/1989 | Falconer | 73/151.5 |
| 4,876,886 | 10/1989 | Bible et al. | 73/151.5 |

FOREIGN PATENT DOCUMENTS

| | | |
|---|---|---|
| 0293767 | 12/1988 | European Pat. Off. . |
| 2183831 | 6/1987 | United Kingdom . |

OTHER PUBLICATIONS

"Separating Bit and Lithological Effects from Drilling Mechanics Data", I. G. Falconer et al., IADC/SPE 17191, Dallas, Tex., 1988.

"The Drilling Porosity Log", W. A. Zoeller, SPE 3066, 45th SPE Annual Fall Mtg., 1972.

*Primary Examiner*—Hezron E. Williams

*Assistant Examiner*—Kevin D. O'Shea

*Attorney, Agent, or Firm*—John J. Ryberg; Henri Dupont; Stephen L. Borst

[57] ABSTRACT

The invention relates to a method of determining the porosity of an undergound formation being drilled by a rotating drill bit mounted at the lower end of a drill string. The torque (TOR) and the weight (WOB) applied on the bit when drilling the underground formation are measured; the effect of the geometry of the drill bit on the torque and weight on bit response is determined; the porosity (phi) of the formation being drilled is derived from the measured TOR and WOB taking into account the effect of the geometry of the drill bit. Preferentially, the porosity phi is determined from the following equation:

$$TOR=(k_1+k_2\cdot\text{phi})\text{WOB}^a$$

where $k_1$, $k_2$ and a are parameters characteristic of the geometry of the drill bit.

11 Claims, 3 Drawing Sheets phi
% 30
20
10
0.2
0.4
0.6
0.8
d(m)

TOR
(N.m.)
3000
2000
1000
0.2
0.4
0.6
0.8
d(m)

WOB
(kn)
150
100
50
0.2
0.4
0.6
0.8
d(m)

METHOD OF DETERMINING THE POROSITY OF AN UNDERGROUND FORMATION BEING DRILLED

The present invention relates to a method of determining the porosity of an underground formation being drilled. Knowing the porosity of the formations penetrated during the course of drilling an oil or gas well is useful both for the solution of a variety of drilling problems, such as determining the formation being drilled by correlation with offset wells and avoiding blow-outs by monitoring compaction trends, and for the estimation of the quantity of hydrocarbon recoverable from the well.

The porosity of a formation can be estimated from measurements made with wireline density, neutron and sonic logging tools. These all have the major drawback that the measurements can only be made when the drill string has been pulled out of the borehole, so that they may not be made until several days after the formation was drilled. They cannot therefore be used to assist in the solution of current drilling problems.

A number of mathematical models of the drilling process relate the rate of penetration of a drill bit to the weight on bit, the rotary speed of the bit, the bit geometry and wear state, and the drilling strength of the rock being drilled. Use has been made of correlations between the porosity of a rock of known rock type and drill bit penetration rate, either alone or combined with other parameters, to infer the value of the porosity. An example is given in the Society of Petroleum Engineer (SPE) article, entitled "The drilling porosity log", from W. A. Zoeller, reference SPE 3066 and presented at the 45th SPE Annual Fall Meeting, 1972. Another example is given in U.S. Pat. No. 4,064,749 wherein a relationship is given between the following parameters: torque, weight on bit, rotational speed of the bit, bit diameter, penetration rate and atmospheric compressive strength. This method has produced good results, but suffers from the disadvantage that the penetration rate is greatly influenced by rock properties other than its porosity, and by other factors. Consequently, the correlations between porosity and drill bit penetration rate, either alone or combined with other parameters, are restricted to given geographical areas, and change from one location to another. In addition, more measurements are necessary compared with the present invention, such as the depth and the revolutions of the bit.

Another example of the use of correlations between several drilling parameters is given in the article entitled "Separating bit and lithological effects from drilling mechanics data" by I. G. Falcone et al, published by the Society of Petroleum Engineers under the reference IADC/SPE 17191. In this article, a qualitative indication of the lithology of the formation being drilled is given by plotting the ratio Torque/(Weight on bit.D) versus 1/FORS, FORS being the formation strength and D the diameter of the drill bit.

A further example is given in U.S. Pat. No. 4,685,329, wherein a correlation between the parameters torque, weight on bit, rate of penetration and rotation rate is used mainly for monitoring the change in the state of wear of the drill bit. However, for a known state of wear of the bit, soft and hard formations can be differentiated.

This invention provides a means of determining the porosity of a formation at the time that it is drilled by using measurements of the weight applied to the drill bit and the torque required to rotate the bit. These measurements are preferentially made downhole with equipment placed just above the drill bit in the drill string. They are commercially available with the Measurement While Drilling (MWD) technology.

According to the present invention, a method of determining the porosity of an underground formation being drilled by a rotating drill bit mounted at the lower end of a drill string, comprises the following steps: measuring the torque (TOR) and the weight (WOB) applied on the bit when drilling the underground formation; determining the effect of the geometry of the drill bit on the torque and weight on bit response; and determining the porosity (phi) of the formation being drilled from the measured TOR and WOB taking into account the effect of the geometry of the drill bit.

Preferentially, the porosity phi is determined from the following equation:

$$TOR=(k_1+k_2\cdot\text{phi})WOB^a$$

where $k_1$, $k_2$ and a are parameters characteristic of the geometry of the drill bit. They can be determined either by mathematical modelling or by experiments. For example, the value of the parameter a can be determined by measuring the successive values of TOR and WOB when the bit is drilling through the same formation of substantially constant porosity. The values of parameters $k_1$ and $k_2$ can be determined by measuring the successive values of TOR and WOB for the same bit drilling formations of at least two known different porosities.

When appropriate, the bit wear is determined during the course of the drilling operation and the values of $k_1$ and $k_2$ are adjusted accordingly.

In order that features and advantages of the present invention may be further understood and appreciated, the following examples are presented, with reference to the accompanying drawings, of which:

FIGS. 4(*a*)–4(*c*) illustrate logs of porosity versus depth, torque (TOR) versus depth, and weight-on-bit (WOB) versus depth, respectively.

Figure 5:
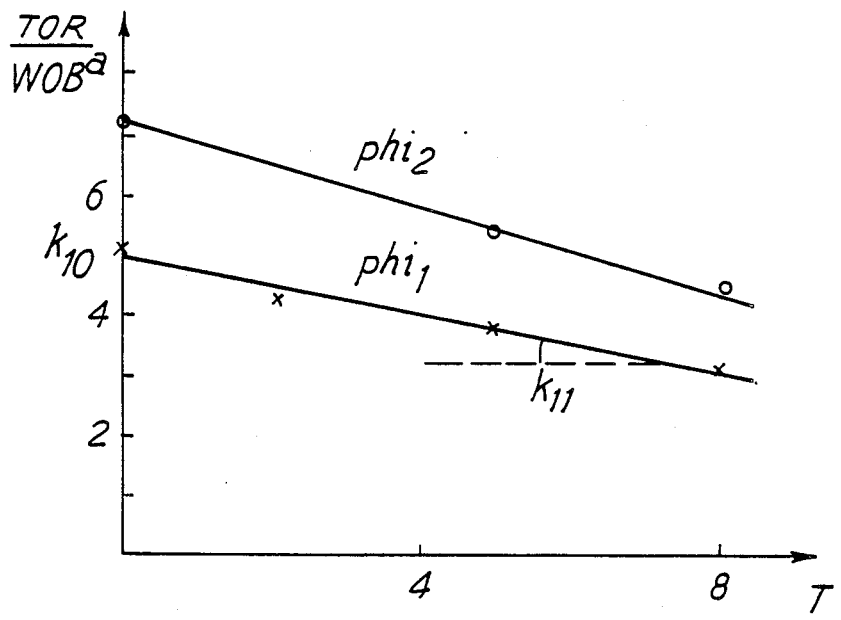

FIG. 5 illustrates the influence of bit-tooth wear on bit torque for a milled tooth bit.

Figure 1:
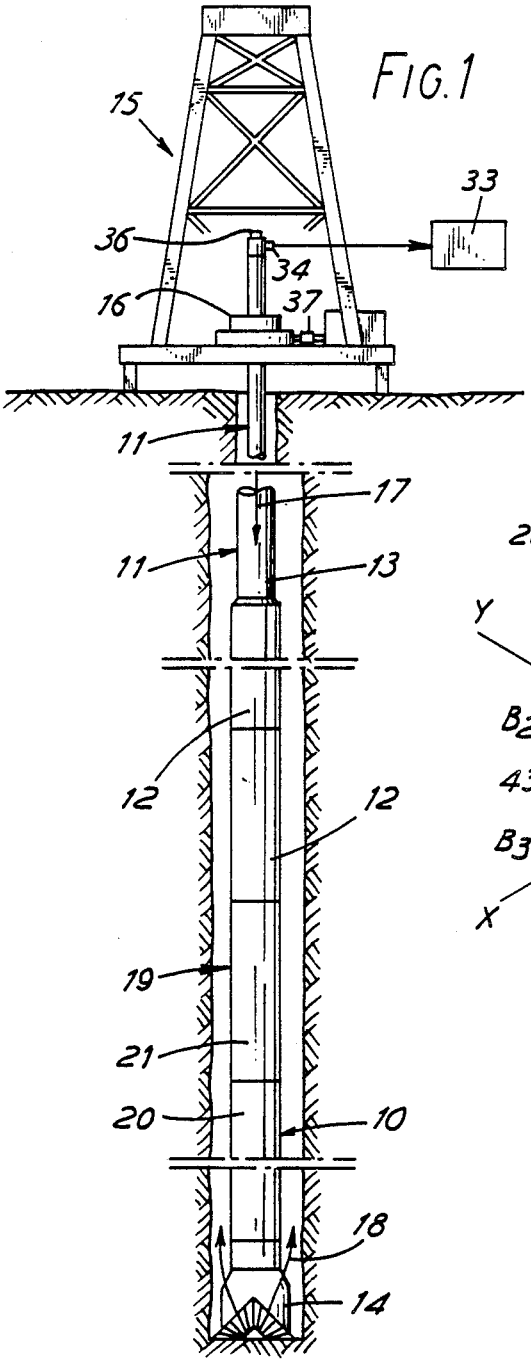
FIG. 1 represents a schematic illustration of a drilling rig and a borehole having a drill string suspended therein which incorporates a sensor apparatus for the measurement of torque and weight on bit downhole.

On FIG. 1, an apparatus suitable for performing a method according to a preferred embodiment of the invention includes a measurement-while-drilling (MWD) tool 10 dependently coupled to the end of a drill string 11 comprised of one or more drill collars 12 and a plurality of tandemly connected joints 13 of drill pipe. Earth boring means, such as a conventional drill bit 14, are positioned below the MWD tool. The drill string 11 is rotated by a rotary table 16 on a conventional drilling rig 15 at the surface. Mud is circulated through the drill string 11 and bit 14 in the direction of the arrows 17 and 18.

As depicted in FIG. 1, the tool 10 further comprises a heavy walled tubular body which encloses weight and torque measuring means 20 adapted for measuring the torque (TOR) and weight (WOB) acting on the drill bit 14. Typical data signalling means 21 are adapted for transmitting encoded acoustic signals representative of the output of the sensors 20 to the surface through the downwardly flowing mud stream in the drill string 11. These acoustic signals are converted to electrical signals by a transducer 34 at the surface. The electrical signals are analyzed by appropriate data processing means 33 at the surface.

As indicated, the preferred embodiment comprises an MWD system to make the torque and weight-on-bit measurements downhole, in order to not take into account the frictions of the drill string along the wall of the borehole. However, for shallow vertical wells, the torque and weight-on-bit may be determined from surface measurement when these frictions are negligible. For that purpose conventional sensors for measuring hookload and torque applied to the drill string, 36 and 37 respectively, are located at the surface. A total depth sensor (not shown) is provided to allow for the correlation of measurements with depth.

Figure 2:
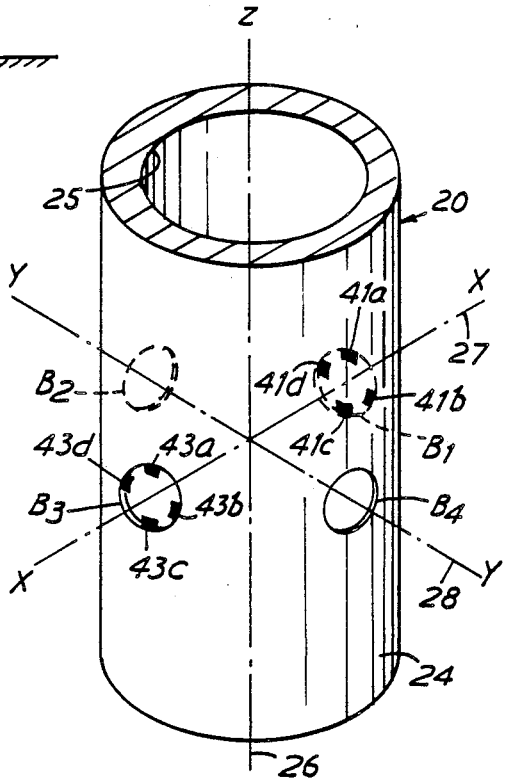
FIG. 2 shows a schematic diagram of torque and weight-on-bit measuring means.

Turning now to FIG. 2, the external body 24 of the force-measuring means 20 is depicted somewhat schematically to illustrate the spatial relationships of the measurement axes of the body as the force-measuring means 20 measure weight and torque acting on the drill bit 14 during a typical drilling operation.

The body 24 has a longitudinal or axial bore 25 of an appropriate diameter for carrying the stream of drilling mud flowing through the drill string 11. The body 24 is provided with a set of radial openings, B1, B2, B3 and B4, having their axes all lying in a transverse plane that intersects the longitudinal Z-axis 26 of the body. It will, of course, be recognized that in the depicted arrangement of the body 24 of the force-measuring means 20, these openings are cooperatively positioned so that they are respectively aligned with one another in the transverse plane that perpendicularly intersects the Z-axis 26 of the body. For example, as illustrated, one pair of the holes B1 and B2, are respectively located on opposite sides of the body 24 and axially aligned with each other so that their respective central axes lie in the transverse plane and together define an X-axis 27 that is perpendicular to the Z-axis 26 of the body. In like fashion, the other two openings B2 and B4 are located in diametrically-opposite sides of the body 24 and are angularly offset by 90 degrees from the first set of openings B1 and B3 so that their aligned central axes respectively define the Y-axis 28 perpendicular to the Z-axis 26 as well as the X-axis 27.

In order to measure the longitudinal force acting downwardly on the body member 24 so as to determine the effective WOB, force-sensing means are mounted in each quadrant of the openings B1 and B3. To achieve maximum sensitivity, these force-sensing means (such as typical strain gauges 41*a*–41*d* and 43*a*–43*d*) are respectively mounted at the 0-degrees, 90-degrees, 180-degrees and 270-degrees positions within the openings B1 and B3. In a like fashion, to measure the rotational torque imposed on the body member 24, rotational force-sensing means, such as typical strain gauges (not illustrated) are mounted in each quadrant of the openings B2 and B4. Maximum sensitivity is provided by mounting the strain gauges at the 45-degrees, 135-degrees, 223-degrees and 315-degrees positions in the opening B2 and B4. Measurement of the weight-on-bit is obtained by arranging the several strain gauges 41*a*–41*d* and 43*a*–43*d* in a typical Wheatstone bridge to provide corresponding output signals (i.e., WOB). In a like manner, the torque measurements are obtained by connecting the several gauges of openings B2–B4 into another bridge that produces corresponding output signals (i.e., TOR). A complete description of a weight-on-bit and torque measuring apparatus is given in U.S. Pat. No. 4,359,898 which is herein incorporated by reference.

A mathematical model has been developed to determine the relation between the drilling response of a particular bit and the lithology of the rock being drilled. The model provides a relation of the form:

$$TOR = f\{WOB, \text{bit geometry, lithology}\} \quad (1)$$

If the bit geometry is known, then expressions of the above form allow the drilling parameters TOR and WOB to be interpreted in terms of the lithology of the rock being drilled. Expression (1) is particularly interesting because it is independent of the rate of penetration and the rotational speed of the drill bit. In addition, the expression makes use of the torque which is insensitive to the rotational speed of the bit, in the range of speeds used for drilling.

Experimentally it has been shown that the key parameter determining the lithology dependence of (1) is the porosity (phi). It is then possible to express the parameters TOR, WOB and phi in a relation which is particularly suitable for interpreting field data.

Drilling experiments have been performed; they have indicated that the torque can be related to the weight-on-bit and the porosity of the formation being drilled by $$TOR = (k_1 + k_2 \cdot \text{phi}) WOB^a \quad (2)$$

where $k_1$, $k_2$ and a are characteristic of the geometry of the drill bit in use. The values of these parameters depend on the size of the bit and of the type of bit (multicone bit or polycrystalline diamond carbide (PDC) bit for example).

Figure 3:
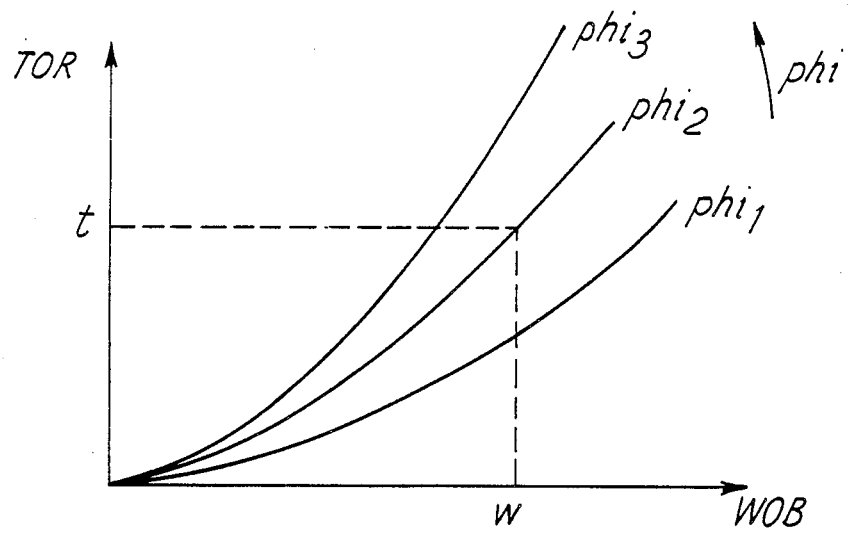
FIG. 3 is a cross plot of torque versus weight on bit for different values of porosity.

A first alternative to determine the porosity of a formation being drilled in the field is to use cross plots representing torque versus weight-on-bit for different porosities, each cross plot being specific to a geometry of drill bit. FIG. 3 represents a cross plot, torque versus weight-on-bit for different porosities $phi_1$, $phi_2$ and $phi_3$, the value of the porosity increasing from $phi_1$ to $phi_3$. The cross plot can be made experimentally in the laboratory by drilling with a determined geometry of drill bit formations of different known porosities, and by measuring the successive values of torque with variations of weight-on-bit. The cross plots can also be derived from field data when formations of different known porosities are drilled and by measuring the torque values for different weights-on-bit. Then the porosity of a formation being drilled can be obtained easily from the cross plot corresponding to the geometry of drill bit in use by measuring at least one value of torque and weight-on-bit. On FIG. 3, for example, if the value of torque is equal to t and the value of weight-on-bit is w, then the porosity is equal to $phi_2$.

Another alternative to determine the porosity is to compute first the values of the parameters $k_1$, $k_2$ and a, for the geometry of the drill bit in use. Parameter a is determined by measuring the successive values of torque and weight-on-bit when drilling a formation of constant known porosity. Then, by plotting, for example, the logarithm of torque versus the logarithm of weight-on-bit, the slope of the curve obtained is equal to a (this is clearly apparent from expression 2). Experimentally it has been demonstrated that the value of parameter a can vary between 0.5 to 2, but more likely between 1 and 1.5. In most cases, however, a good approximation of the value of the parameter a is 1.2 or 1.25. In order to determine the values of parameters $k_1$ and $k_2$, the same drill bit is used to drill rocks of different known porosities and the successive values of torque and weight-on-bit are measured. An easy way, for example, to obtain the value of parameter $k_2$ is by drilling with the same weight-on-bit at least two rocks of different known porosities and to measure the corresponding two values of torque. The value of $k_2$ is then easily obtained from equation (2), assuming the value of parameter a is known. Knowing $k_2$, the value of $k_1$ is directly derived from equation (2). Another alternative to determine the values of parameters $k_1$, $k_2$ and a would be to model mathematically the interaction of the type of drill bit with formations of known porosities.

Knowing the values of parameters $k_1$, $k_2$ and a characterizing the bit in use, the porosity can be calculated from measured torque and weight-on-bit values using the following expression derived from equation (2).

$$\text{phi}=\{(TOR/WOB^a)-k_1\}/k_2 \quad (3)$$

Figures 4A, 4B, 4C:
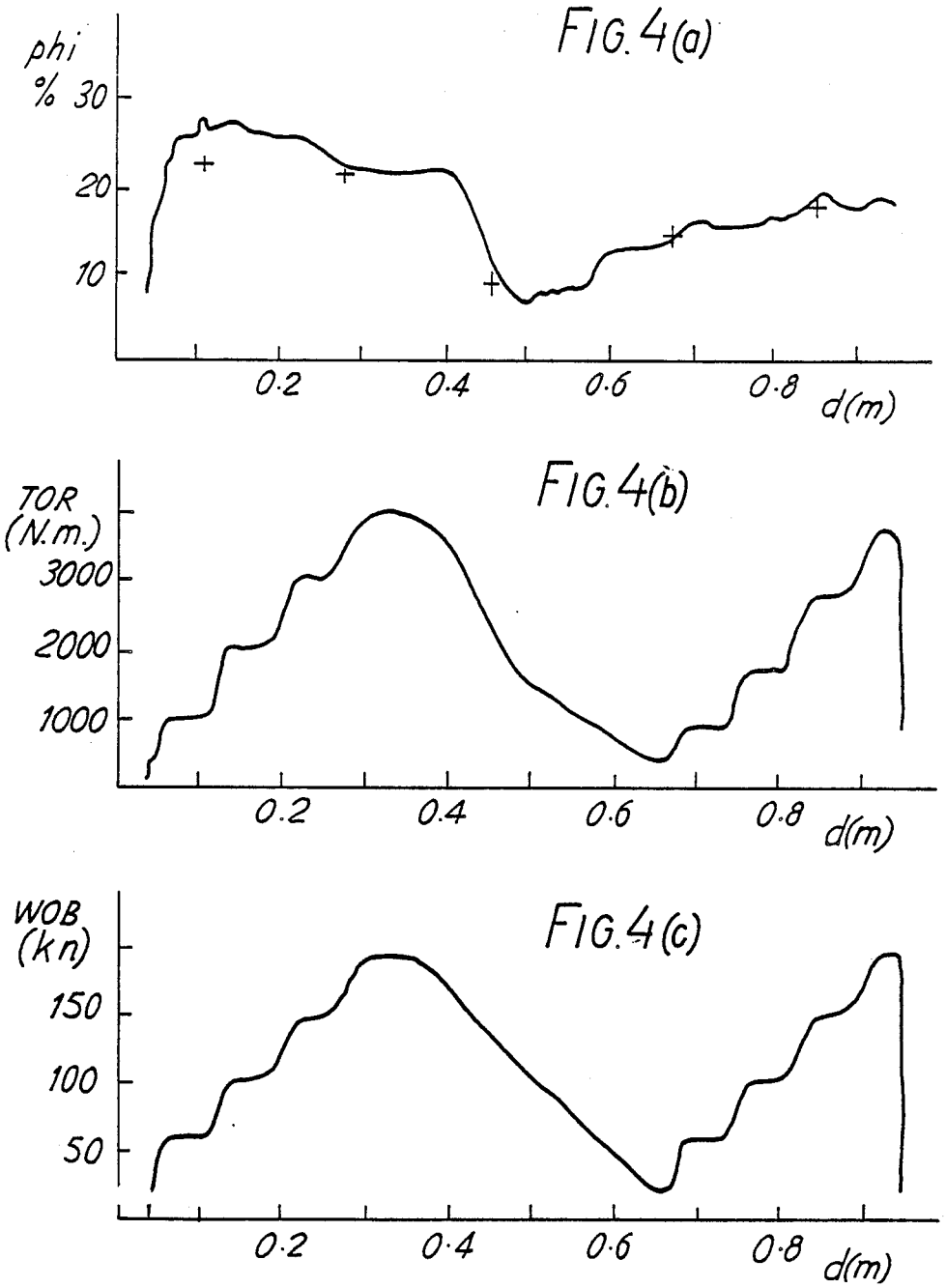

The torque and weight-on-bit should be measured at suitable intervals during the drilling operation, say once every foot drilled, and the porosity of the formation drilled at that point can be computed using equation (3). Then, if desired, the computed porosity can be plotted as a function of depth or another suitable indexing parameter to yield a log of porosity for the formations drilled. An example of such a log is shown in FIGS. 4(*a*)–4(*c*) in which the porosity phi (FIG. 4*a*), expressed in %, is plotted as a function of the depth drilled (in meters). A sample of Portland limestone, having the shape of a cylinder of 1 meter high and 60 centimeters of diameter, was drilled with a Hughes J3 three cone bit. The values of TOR (in Nm) and WOB (in kN) were recorded and plotted (FIG. 4*b* and 4*c* respectively) as a function of the depth drilled (in meters). The values of porosity plotted as a log, represented in FIG. 4*a*, was taken computed from the expression (3), with a=1.2. A few cores were taken from the sample for different depths and their porosity measured by conventional laboratory core testing means. These measurements are represented by crosses on FIG. 4.

The geometry of some drill bits changes with wear in such a way that the bit characterizing parameters may change as the bit wears whilst drilling. In that case, the bit wear must be determined during the course of the drilling operation and the values of the bit characterizing parameters adjusted accordingly. Denoting, as it is the practice in the industry, the wear state of the bit by the grading symbol T, which ranges from 0 for an unworn bit to 8 for a bit on which the cutting structure is fully worn, the impact of bit wear on the bit characterizing parameters can be represented by:

$$k_1=k_1(T) \text{ and } k_2=k_2(T) \quad (4)$$

A suitable functional form for these expressions is:

$$k_1=k_{10}+k_{11}\cdot T \text{ and } k_2=k_{20}+k_{21}\cdot T \quad (5)$$

where $k_{10}$, $k_{11}$, $k_{20}$ and $k_{21}$ are characteristics of the bit in use.

FIG. 5 illustrates the influence of bit-tooth wear on bit torque for a milled tooth bit for two rocks of different porosities, $\text{phi}_1$ (which was a marble) and $\text{phi}_2$ (which was a sandstone), $\text{phi}_1$ being lower than $\text{phi}_2$. The ratio $TOR/WOB^a$ has been plotted as a function of bit wear grading T for two different porosities $\text{phi}_1$ and $\text{phi}_2$ and for a=1.2. By combining expressions (2) and (5), one obtains:

$$TOR/WOB^a=k_{10}+k_{11}T+(k_{20}+k_{21}T)\text{phi} \quad (6)$$

The curves representing $TOR/WOB^a$ as a function of T are straight lines, for constant values of phi. Assuming phi=0 (which is the case in FIG. 5 for the curve $\text{phi}_1$), expression (6) becomes:

$$TOR/WOB^a=k_{10}+k_{11}T$$

It is therefore apparent that $k_{10}$ is the intercept on FIG. 5 of the straight line $\text{phi}_1$, with the ordinate axis (for T=0) and that $k_{11}$ is the slope of the line.

Expression (6) can also be written as follows:

$$TOR/WOB^a=(k_{10}+k_{20}\text{phi})+(k_{11}+k_{21}\text{phi})T \quad (7)$$

The values of the parameters $k_{20}$ and $k_{21}$ can be easily derived from expression (7), knowing the values of porosity, such as $\text{phi}=\text{phi}_2$ in FIG. 5, and the values of $k_{10}$ and $k_{11}$ as determined previously.

One method for determining the wear of the bit is, for example, described in U.S. Pat. No. 4,685,329 which is incorporated herein by reference. Other methods could also be used. Having determined the instantaneous wear state T of the bit, the appropriate values of the bit characterizing parameters $k_1$ and $k_2$ are computed and the porosity is then computed using equation (3). Again a porosity log can be recorded if so desired.

The problem of wear is only significant in the case of milled tooth bits and no correction for wear is required in the case of insert bits unless indentors have been broken off.

The determination of the porosity and the parameters characteristic of the geometry of the drill bit has been made in the above described examples graphically. It is obvious for those skilled in the art that it could be made by computation and comparison steps within a computer.

We claim:

1. Method of determining the porosity of an underground formation being drilled by a rotating drill bit mounted at the lower end of a drill string, comprising the steps of measuring the torque (TOR) and the weight (WOB) applied on the bit when drilling the underground formation; determining the effect of the geometry of the drill bit on the torque and weight-on-bit response; and determining the porosity (phi) of the formation being drilled from the measured TOR and WOB, taking into account the effect of the geometry of the drill bit, wherein said step of determining the effect of the geometry of the drill bit comprises drilling with said bit, or a bit of substantially identical geometry, in the field or in the laboratory, formations of different known porosities; measuring successive values of the torque and weight applied on the bit while drilling; and correlating said successive values and the known porosities to establish an experimental cross plot of TOR as a function of WOB and porosity corresponding to the geometry of the drill bit.

2. Method according to claim 1 wherein the porosity of the formation being drilled in the field by said drill bit is determined by measuring at least one value of TOR and WOB and by using the experimental cross plot corresponding to the geometry of said drill bit to determine the porosity of the formation being drilled.

3. Method of determining the porosity of an underground formation being drilled by a rotating drill bit mounted at the lower end of a drill string, comprising the steps of measuring the torque (TOR) and the weight (WOB) applied on the bit when drilling the underground formation; determining the effect of the geometry of the drill bit on the torque and weight-on-bit response; and determining the porosity (phi) of the formation being drilled from the measured TOR and WOB, taking into account the effect of the geometry of the drill bit, wherein said step of determining the effect of the geometry of the drill bit comprises the mathematical modelling of the drill bit so as to produce a model describing the effect on the torque and weight on bit response for different geometries of drill bits.

4. Method of determining the porosity of an underground formation being drilled by a rotating drill bit mounted at the lower end of a drill string, comprising the steps of measuring the torque (TOR) and the weight (WOB) applied on the bit when drilling the underground formation; determining the effect of the geometry of the drill bit on the torque and weight-on-bit response; and determining the porosity (phi) of the formation being drilled from the measured TOR and WOB, taking into account the effect of the geometry of the drill bit, wherein the step of determining the porosity (phi) is carried out in accordance with the following equation:

$$TOR=(k_1+k_2 \cdot phi)WOB^a$$

where $k_1$, $k_2$ and a are parameters characteristic of the geometry of the drill bit.

5. Method according to claim 4 wherein the value of the parameter a is determined, for a geometry of the drill bit, by measuring successive values of TOR and WOB while drilling with said geometry of drill bit in a formation of substantially constant porosity and by correlating the measured values of TOR and WOB to determine the parameter a.

6. Method according to claim 5 wherein the value of parameter a is chosen between 0.5 and 2.

7. Method according to claim 5 wherein the value of parameter a is chosen equal to about 1.2.

8. Method according to claim 4 wherein the values of parameters $k_1$ and $k_2$ are determined for a geometry of the drill bit by drilling, in the field or in the laboratory, formations of at least two known different porosities with a drill bit having said geometry, measuring the values of TOR corresponding to at least one value of WOB, and by computing $k_1$ and $k_2$ from the equation of claim 4.

9. Method of determining the porosity of an underground formation being drilled by a rotating drill bit mounted at the lower end of a drill string, comprising the steps of measuring the torque (TOR) and the weight (WOB) applied on the bit when drilling the underground formation; determining the effect of the geometry of the drill bit on the torque and weight-on-bit response; and determining the porosity (phi) of the formation being drilled from the measured TOR and WOB, taking into account the effect of the geometry of the drill bit, wherein the change in the states of wear (T) of the drill bit is monitored whilst drilling and the effect of the geometry of the drill bit is adjusted to account for the change in the state of wear of the drill bit.

10. Method according to claim 9 wherein the change in the states of wear (T) of the drill bit is monitored whilst drilling and the effect of the geometry of the drill bit is adjusted to account for the change in the state of wear of the drill bit.

11. Method according to claim 10 wherein the values of the parameters $k_1$ and $k_2$ are computed as a function of the state of wear (T) of the drill bit by measuring the successive values of TOR and WOB whilst drilling formations of at least two known porosity values (phi), monitoring the state of wear T of the drill bit while drilling, and computing the different values of $k_1$ and $k_2$ as a function of T by correlating the values of TOR, WOB, phi and T.

* * * * *